United States Patent [19]

Pless

[11] 4,258,240

[45] Mar. 24, 1981

[54] METHOD AND APPARATUS FOR RADIO FREQUENCY DRYING OF LUMBER

[75] Inventor: John H. Pless, London, England

[73] Assignee: Electron Kilns (Luzern) GmbH, of Zahringerhof, Lucerne, Switzerland

[21] Appl. No.: 9,786

[22] Filed: Feb. 6, 1979

[30] Foreign Application Priority Data

Feb. 7, 1978 [GB] United Kingdom ..... 4912/78

[51] Int. Cl.[3] ..... H05B 6/54; H05B 6/60; F26B 3/34

[52] U.S. Cl. ..... 219/10.41; 219/10.81; 219/10.69; 219/10.75; 34/1; 34/16.5

[58] Field of Search ..... 219/10.81, 10.69, 10.71, 219/10.61 R, 10.75, 10.53, 10.77, 10.57, 10.41, 10.43; 34/1, 4, 9.5, 13.4, 13.8, 16.5; 156/380, 274; 361/245-246

[56] References Cited

U.S. PATENT DOCUMENTS

| | | | |
|---|---|---|---|
| 2,147,689 | 2/1939 | Chaffee | 34/1 |
| 2,397,897 | 4/1946 | Wenger | 34/1 |
| 2,415,025 | 1/1947 | Grell et al. | 219/10.81 |
| 2,434,573 | 1/1948 | Mann et al. | 34/1 |
| 2,679,111 | 5/1954 | Leischner | 34/9.5 |
| 2,838,640 | 6/1958 | Mann et al. | 219/10.81 |
| 2,873,345 | 2/1959 | Gard | 219/10.61 |
| 3,291,671 | 12/1966 | Hecht | 156/380 |
| 3,884,213 | 5/1975 | Smith | 219/400 |

FOREIGN PATENT DOCUMENTS

| | | | |
|---|---|---|---|
| 1389541 | 4/1975 | United Kingdom | 34/1 |

*Primary Examiner*—C. L. Albritton
*Assistant Examiner*—Philip H. Leung
*Attorney, Agent, or Firm*—Kemon & Estabrook

[57] ABSTRACT

In a method of drying boards by radio-frequency heating a stack of boards is passed between live and earthed electrodes. The connections to the electrodes are periodically reversed so that each is alternately live and earthed; this increases the uniformity of heating in the stack. Preferably the boards are stacked in short spacer sticks to delay the escape of steam from intermediate boards in the stack and reduce surface checking. The escape of steam from the top and bottom boards of the stack to be dried can be delayed by using top and bottom covering boards treated with a liquid substantially unaffected by radio-frequency heating.

9 Claims, 2 Drawing Figures

METHOD AND APPARATUS FOR RADIO FREQUENCY DRYING OF LUMBER

Figure 1:
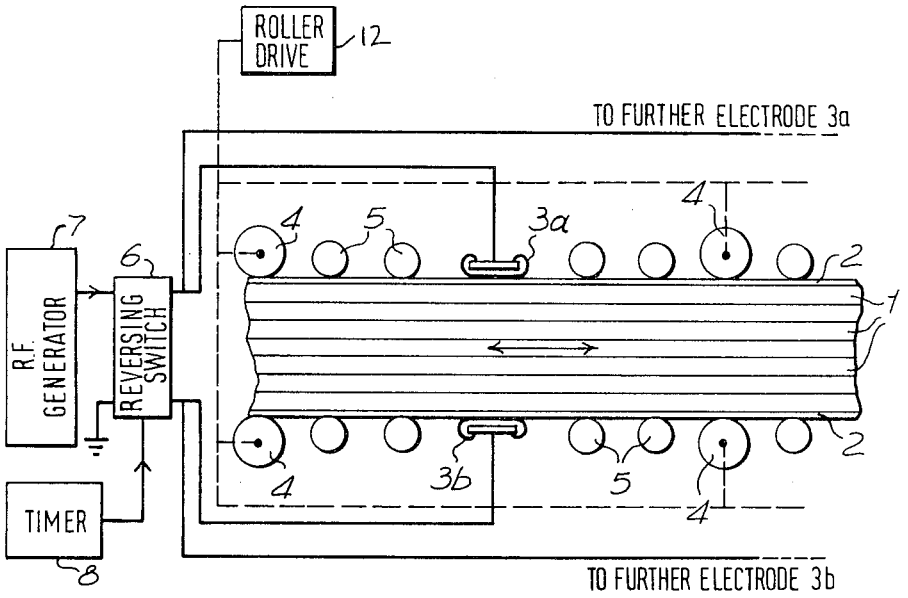

This invention relates to the drying of lumber, i.e. boards, planks or veneer cut from logs of timber, or boards composed of timber (for example, chipboard). In a conventional kiln drying process, the moisture content of boards of timber is reduced by convection drying. The boards are stacked with spacer sticks between them and the kiln temperature may be raised from about 45° C. (80% RH) to about 80° C. (40% RH) over a period of two to four days for soft woods and about four to seven weeks for hard woods.

More recently, continuous processes have been developed in which lumber is conveyed through a drying chamber continuously at a higher temperature. Also, more rapid drying can be carried out by means of radio frequency heating. In the latter method, each board is conveyed between electrodes and heat is generated throughout the board by the electric field. The moisture within the board turns to steam which finds its way to the surfaces of the board. However, if the heating of the boards is too fast the steam generated within the boards will cause them to split. In one method which I have previously used the board is subjected to radio frequency heating intermittently (for example one minute within the alternating electric field and three minutes outside the field) for one hour and then rests for an hour, and so on. This was accomplished by reciprocating motion of the board between pairs of electrodes of a size and spacing suitable to produce such an on/off ratio.

Attempts have also been made in radio-frequency installations to copy the practice in conventional kilns by drying simultaneously a stack of boards separated by spacers. However, the thickness of the stack which can be dried in this way was found to be limited to a few inches, as when the stack thickness was further increased the heating became very uneven in the direction of stack thickness.

A method according to the present invention for drying boards by radio-frequency heating comprises stacking the boards to be dried and relatively moving the stack, on the one hand, and first and second electrodes, on the other hand, the first and second electrodes being adjacent opposite faces of the stack and connected to the output terminals of a radio-frequency generator, one of the output terminals being earthed and the other live, and periodically reversing the connections between the electrodes and the radio-frequency generator, whereby the first and second electrodes are alternately live and earthed respectively and earthed and live respectively.

Preferably the application of radio-frequency heating to each portion of the boards is intermittent. This can be achieved by passing the boards between electrodes which are short in the direction of movement of the boards in comparison with their spacing in this direction. If desired, the boards can be given a reciprocating movement.

A critical part of rapid lumber drying processes is the moistening of the lumber surface, since otherwise the surfaces of the board dry out in advance of the centre of the board and this results in surface checking, end splitting and case hardening. One known method of maintaining the surface moist is to subject the board from time to time to a fine spray of water. In my British Pat.

No. 1,389,541, I have suggested the use of a rotatable wetting roller to maintain moist the surface of lumber during its passage through the drying chamber. This method or an alternative method to be described below, can be used with the present invention.

Figure 2:
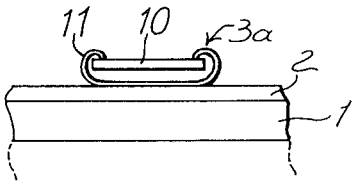

In order that the invention may be better understood, one example will now be described with reference to the accompanying drawings, in which:

FIG. 1 illustrates a first method of drying timber by radio-frequency heating; and FIG. 2 illustrates a form of electrode that can be used in the apparatus of FIG. 1.

In FIG. 1, the boards of a stack of lumber to be dried are indicated by the reference 1. In this example, top and bottom re-usable boards 2 are placed over and under the stack of boards 1 for a purpose which will be described later. The assembly of boards, including the top and bottom boards, passes between electrodes 3*a* and 3*b* which in this example have a length of 3 inches and a spacing of 4 feet in the direction of board movement indicated by the arrow. Rollers 4 rotated by a roller drive 12 are responsible for the reciprocating movement of the boards, which is 4 feet in each direction. Rollers 5 serve to support and guide the boards and are freely rotatable. The electrodes 3*a* are connected to a first output of a reversing switch 6 and the electrodes 3*b* to the second output of the reversing switch. The reversing switch, which is operated periodically by a timer 8, periodically reverses the connections between the electrodes, on the one hand, and the output of a radio-frequency generator 7 and earth, on the other hand. The effect of this is that during the drying operation for a first period of time the electrodes 3*a* are live and the electrodes 3*b* earthed, and for the succeeding period of time the electrodes 3*a* are earthed and the electrodes 3*b* live, after which the original condition is re-established and so on. As explained above, this results in a greater uniformity of heating because the non-uniformity in the top to bottom direction of the stack when the top electrodes are live is reversed when the top electrodes are earthed. The invention can be used with any stack height but becomes practical essentially for stack heights of over one foot. Using the invention, typically we dry stacks with a height of up to four feet.

A suitable form of electrode, shown in FIG. 2, comprises a plate 10 around which is fixed a resilient strip of copper 11. This ensures good contact between the electrode and the surface of the board assembly. Other forms of electrode can of course be used.

The example shown departs from conventional kiln drying practice in that the boards to be dried are stacked without spacers. In this way the main surfaces of the intermediate boards are kept moist by contact with each other. The escape of steam from the boards during the radio-frequency heating is thereby delayed, thus reducing the danger of surface checking due to the main surfaces of the boards drying before their centres. Furthermore, the stack of boards 1 is arranged between re-usable top and bottom boards 2. These boards 2 in the preferred form, are impregnated with a liquid substantially unaffected by radio-frequency heating. The non-polar liquids paraffin and glycol are suitable. These treated top and bottom boards are re-usable and remain moist with the non-polar liquid and with the moisture that they absorb from the adjacent surfaces of the boards to be dried. The top and bottom boards keep moist the main surfaces of the adjacent boards i.e. the top and bottom boards 1 and thereby reduce the danger of surface checking in these outside boards 1.

In this example, the electrodes may have a length of 3 inches in the direction of board movement and may be spaced at intervals of 4 feet. The ratio of the "off" period of radio-frequency heating to the "on" period is then 15:1. With such a ratio, a field of high strength is used and the lumber experiences a considerable thermal shock, leading to the generation of super-heated steam. The rate of movement of the boards in their reciprocating motion may be 10 inches per minute, but in my preferred method, the return motion takes place at a higher speed, for example 4 feet in 10 seconds. It is found unnecessary to provide the longer rest periods of one hour, for example, which were used in the earlier process described above.

In the above example, the top and bottom re-usable boards 2 move with the stack of lumber to be dried. However, in an alternative form, the top and bottom boards are fixed and only the boards to be dried are reciprocated. This can be done for example, by providing gaps between sections of each board 2, in which gaps the driving rollers engage the boards 1.

Using the process described above, I am able to dry Canadian hemlock, for example, in 2 to 3 hours, which is about one third of the time required in earlier methods of high frequency drying. Conventional kiln drying of this wood would take several days.

The temperature to which the wood is raised and the pressure which can be generated within the wood vary with the lumber to be dried. For soft wood, the temperature may be 105° C., for example, with a steam pressure of 5 p.s.i. For some hard woods, the the temperature may be 150° to 160°, with an internal pressure of 50 to 60 p.s.i. The voltage applied across the electrodes is lower for wet timber than for dry timber.

The voltage and frequency of the waveform applied across the electrodes depends, inter alia, on the moisture content of the lumber. The voltage is normally in the range 500–6000 V and the frequency within the permissible bands in the range from 2 MHz to 100 MHz.

Details of three examples of drying methods embodying the invention for different types of timber are given below. The electrode width is its dimension in the direction of movement of the stack. The electrode length (perpendicular to the direction of movement) is governed by the width of the stack; stack widths of up to 6 feet have been used. In the following examples, the stack width (and electrode length) was 3 feet.

| Species: | Hemlock | Utile | Oak (English) |
|---|---|---|---|
| Dimensions: | 12′ × 6″ × 2″ | 10′ × 12″ × 1″ | 2′ × 6″ × 2″ |
| Height of Stack | 1ft–3ft | 2 ft | 2 ft |
| Width of Electrode | 6.86 ins | 17 ins | 3.69 ins |
| Spacing of Electrodes: | 4 ft | 4 ft | 4 ft |
| Speed of Timber Movement: | 10″/min | 10″/min | 10″/min |
| RF on/off ratio: | 1 to 6 | 1 to 2 | 1 to 12 |
| Temperature of timber: | 115°–120° C. | 105°–110° C. | 104°–112° C. |
| Steam pressure rise of timber: | 10–20 p.s.i. | 7 p.s.i. | 7 p.s.i. (app) |
| Drying Time: | 3 hrs | 1 hr | 22 hrs |
| Moisture Loss: | 2.8 lb/cu.ft/hr | 3.5 lb/cu.ft/hr | 0.2 lb/cu.ft/hr |

The voltage across the electrodes varies with the moisture content of the timber. The frequency of the RF generator may lie in any of the dielectric heating bands permitted by international agreement, for example 13.56 MHz, 27.12 MHz or 40.68 MHz.

Although in the above description and examples reference has been made to moving the timber stack with respect to the electrode, it will be clear that in an alternative method the electrodes could be moved relative to the timber stack.

We claim:

1. A method of drying boards by radio frequency heating comprising:

positioning a stack of boards to be dried between opposed electrodes adjacent opposite sides of the stack;

connecting one of said electrodes to a source of radio frequency current while grounding the other electrode;

periodically reversing the connections of said electrodes to the source and to ground; and causing reciprocating relative movement between said stack and said electrodes in a direction longitudinally of said stack.

2. A method in accordance with claim 1, in which each portion of a board to be dried is subjected to an intermittent radio-frequency field.

3. A method in accordance with claim 2, in which the assembly of boards is given a reciprocating motion between fixed electrodes, whereby each portion of a board is at times within the radio-frequency field generated between the electrodes and at times outside the said field and is thereby subjected to intermittent radio-frequency heating.

4. A method in accordance with claim 1, 2 or 3, in which the boards are stacked with adjacent main surfaces in contact with one another, thereby delaying the escape of steam from intermediate boards in the stack.

5. A method in accordance with claim 1 in which the stack of boards to be dried is assembled between top and bottom re-usable boards treated with a liquid substantially unaffected by radio-frequency heating.

6. A method in accordance with claim 5, in which the top and bottom re-usable boards are treated with paraffin.

7. A method in accordance with claim 5, in which the top and bottom re-usable boards are treated with glycol.

8. Apparatus for drying boards comprising:

a radio frequency generator;

a pair of spaced electrodes;

means for supporting and longitudinally reciprocating a stack of boards between said electrodes; and means including switching means for establishing connections between the output of said generator to one of said electrodes and between the other electrode and ground and for periodically reversing said connections.

9. A method of drying boards by radio frequency heating comprising:

positioning a stack of boards to be dried between opposed electrodes adjacent opposite sides of the stack;

connecting one of said electrodes to a source of radio frequency current while grounding the opposite electrode;

periodically reversing the connections of said electrodes to the source and to ground; and intermittently interrupting the radio frequency heating of each portion of the stack.

* * * * *